US005477694A

United States Patent [19]

Black et al.

[11] Patent Number: 5,477,694

[45] Date of Patent: Dec. 26, 1995

[54] METHOD FOR CONTROLLING AN ICE MAKING MACHINE AND APPARATUS THEREFOR

[75] Inventors: William J. Black, Gurnee, Ill.; Daniel G. Skell; Michael A. Manthei, both of Cedarburg, Wis.

[73] Assignee: Scotsman Group, Inc., Vernon Hills, Ill.

[21] Appl. No.: 245,426

[22] Filed: May 18, 1994

[51] Int. Cl.[6] ..... F25C 1/12

[52] U.S. Cl. ..... 62/73; 62/137; 62/348

[58] Field of Search ..... 62/135, 137, 138, 62/188, 348, 73

[56] References Cited

U.S. PATENT DOCUMENTS

| | | | |
|---|---|---|---|
| 3,430,452 | 3/1969 | Dedricks et al. | 62/138 |
| 3,812,686 | 5/1974 | Tester | 62/188 X |
| 3,964,270 | 6/1976 | Dwyer | 62/138 |
| 4,238,930 | 12/1980 | Hogan et al. | 62/138 |
| 4,341,087 | 7/1984 | Van Steenburgh, Jr. | 62/233 |
| 4,644,757 | 2/1987 | Hida et al. | 62/188 |
| 4,733,539 | 3/1988 | Josten et al. | 62/73 |
| 4,774,814 | 10/1988 | Yingst et al. | 62/126 |
| 4,947,653 | 8/1990 | Day et al. | 62/73 |
| 4,986,081 | 1/1991 | Hida et al. | 62/188 X |
| 5,027,610 | 5/1991 | Hara | 62/135 |
| 5,060,484 | 10/1991 | Bush et al. | 62/137 |
| 5,245,841 | 9/1993 | Paul et al. | 62/302 |
| 5,291,747 | 3/1994 | Sakai et al. | 62/135 |

*Primary Examiner*—William E. Tapolcai
*Attorney, Agent, or Firm*—Harness, Dickey & Pierce

[57] ABSTRACT

A method and apparatus for controlling an ice making machine by monitoring water level in a sump used for water recirculation over an evaporator plate. Self-diagnostic means are also provided for automatic shutdown upon detection of malfunction during various cycles.

16 Claims, 6 Drawing Sheets

METHOD FOR CONTROLLING AN ICE MAKING MACHINE AND APPARATUS THEREFOR

BACKGROUND OF THE INVENTION

1. Field of the Invention

This invention concerns an improved ice making machine and method of controlling it. It more particularly relates to improvements in initiating harvest, terminating harvest, initiating a new freeze cycle, and sensing ice bin full. The invention also incorporates new and improved diagnostic means.

2. The Prior Art

Ice cube makers typically freeze and harvest ice in batches. Ice is formed on an evaporator plate until the desired size and/or thickness is achieved. Once the desired size and/or thickness has been achieved, the machine is put into defrost mode that releases the cubes from the evaporator plate, whereupon they drop into a storage bin.

In the industry, several methods are used to control this cycle of events. Some equipment relies on suction line temperature to signal the end of the freeze cycle. At the end of the freeze cycle, the harvest cycle would begin. The harvest cycle is frequently a defrost cycle on the evaporator plate, often controlled by an adjustable timer. Ice cube bin level control is at times achieved through the use of a thermostat. Because some of the system relies on thermostats and timers, ambient conditions can significantly effect performance of ice cube machines. As might be expected, ambient conditions can differ widely. Accordingly, ice cube machines as delivered to the customer rarely perform satisfactorily without adjustment to the specific ambient conditions of its operating environment. A very large percentage of ice cube making machines require adjustment at least once within the first 60 days of operation.

It is believed that simple changes can be made to currently available ice cube machines to make them operate more satisfactorily even with variations in ambient conditions.

OBJECTS OF THE INVENTION

It is an object of the present invention to provide a new method of controlling the freezing and harvesting of ice cubes in an ice cube maker.

It is another object of the present invention to provide an improved method of making ice cubes that is not significantly affected by differences in ambient operating conditions.

It is also an object of this invention to provide a dual function sensing means, that senses both ice cube harvest and "bin full" for a control means.

It is still further an object of this invention to provide an improved control means for an ice cube maker that includes improved automatic diagnostic needs.

These and other advantages, features and objects of the invention become manifest to those versed in the art upon review and study of the teachings herein.

SUMMARY OF THE INVENTION

This invention involves an electronic controller means for an ice making machine. The electronic controller means can be actuated by any of four push buttons, three of which initiate specific cycles and the fourth of which turns the ice making machine "off" in accordance with a predetermined shutdown sequence. The controller also provides four automatically activated trouble lights, respectively for water error, refrigeration error, harvest error and hot gas error. Self-diagnostics in the electronic controller, recycle operation of the ice maker or shut it down, while concurrently activating one of the four telltale lights. Accordingly, precise diagnosis of difficulty is identified, and repairs more efficiently done.

This invention also provides improved sensing means for indicating that the ice cube bin is full. This invention still further provides means for initiating and terminating harvest, and restarting freezing, that is less affected by ambient conditions. Hence, ice making machines calibrated in the factory are more likely to perform as desired for the customers without adjustment by a service person.

DETAILED DESCRIPTION

Figure 1:
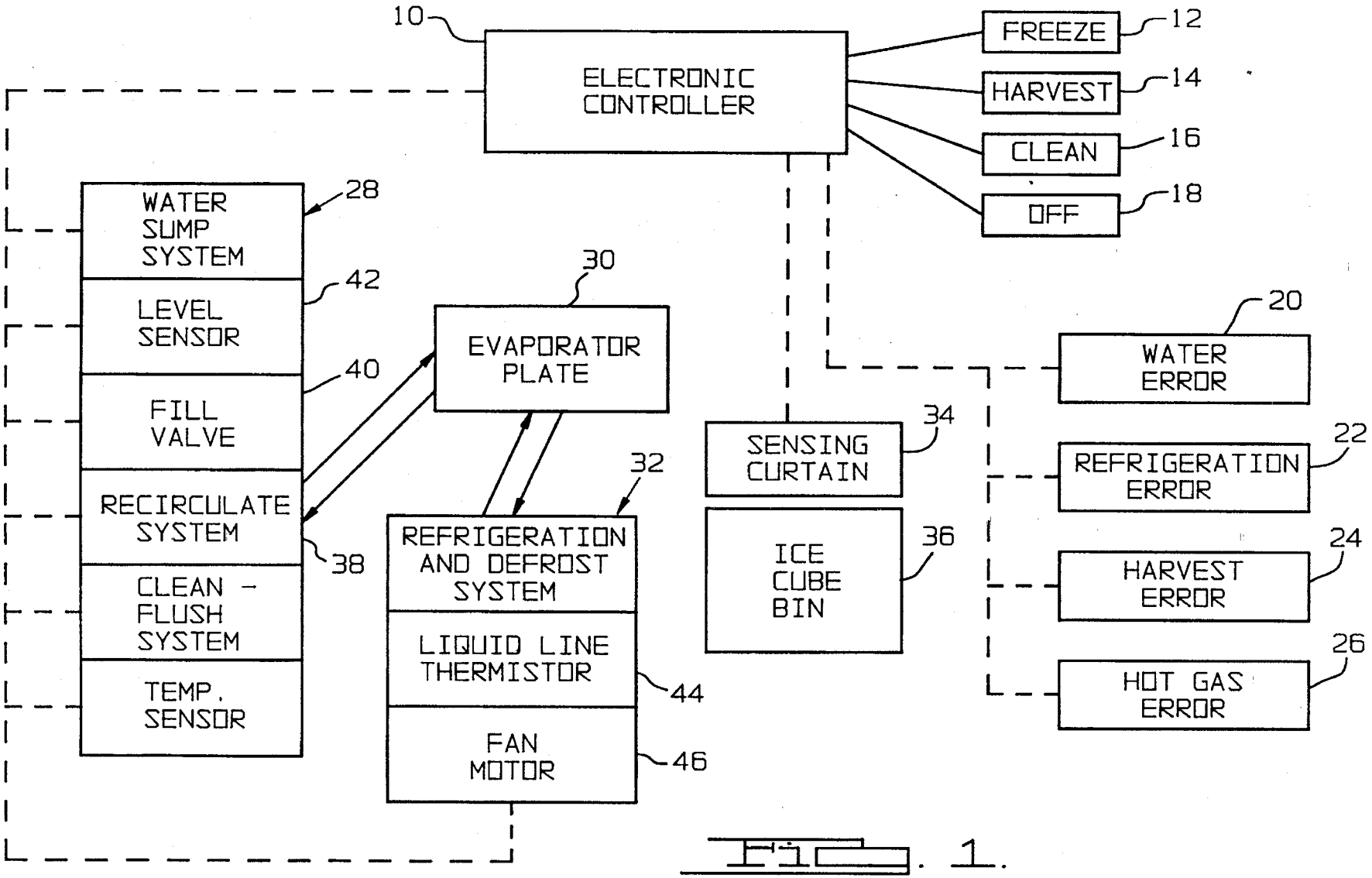
FIG. 1 shows a diagrammatic view of an ice cube maker control system of this invention.

The principles of the present invention can be used with only small modifications of a wide variety of currently available ice cube making machines. The reason for this is that modification required in accordance with this invention requires inclusion of a water sump, the addition of several sensors, and addition of a control unit to operate in accordance with the method hereinafter described.

As indicated above, the objects of this invention can be obtained by appropriately modifying any of the ice makers heretofore known. Examples of such known ice making apparatus and methods are described in U.S. Pat. No. 5,060,484, issued to Bush et al. on Oct. 29, 1991 and U.S. Pat. No. 5,245,841 issued on Sep. 21, 1993, both of which patents are assigned to the assignee of this invention. To the extent the teachings are U.S. Pat. Nos. 5,060,484 and 5,245,841 are relevant to this invention, those teachings are incorporated by reference in this disclosure.

Also, it is recognized that basic components of an ice maker described in connection with this invention are old per se, including the use of an ice curtain in connection with an evaporator plate. These basic components can take many forms, as well as specific embodiments of their control systems. Such apparatus and methods are taught, for example, in U.S. Pat. No. 3,430,452 Dedricks et al.; U.S. Pat. No. 3,964,270 Dwyer; U.S. Pat. No. 4,238,930 Hogan et al.; U.S. Pat. No. 4,341,087 Van Steenburgh, Jr.; U.S. Pat. No. 4,774,814 Yingst et al.; U.S. Pat. No. 4,733,539 Josten et al.; and U.S. Pat. No. 4,947,653 Day et al—To the extent that the teachings of the patents mentioned above in this paragraph are relevant to this disclosure and the invention it contains, such teachings are incorporated herein by reference.

More importantly, the references cited above are mentioned to provide a better focus on what is new in this invention. As previously indicated, this invention involves a new method and apparatus for controlling operation of the basic functions of the ice making machine. An electronic controller 10 is preferably used to perform our improved control.

The electronic controller 10 is preferably actuated by four push buttons, indicated by reference numerals 12–18, mounted on the ice maker control panel. The push buttons could each light up to show function indicia when pressed. For example, one push button 12 would indicate "FREEZE" when pushed. A second 14 would indicate "HARVEST" when pushed. A third 16 would indicate "CLEAN" when pushed. A fourth 18 would indicate "OFF" when pushed. The push buttons are indicated to the right of the electronic controller in FIG. 1.

FIG. 1 also shows diagnostic indicator lights are preferably present on a control panel. This latter control panel need not be the regular operator control panel but could be located behind a service panel. On the other hand, if desired these diagnostic indicator lights could be also incorporated in the regular operator control panel. These diagnostic indicator lights would be operative when the electronic controller shuts the ice maker down for any one of four specific reasons.

The first indicator light 20 would indicate a shutdown of equipment because of water error. The second indicator light 22 would indicate shutdown of the ice maker because of a refrigeration error. The third indicator light 24 would turn on in case of shutdown of the ice maker due to a harvest error. The fourth indicator light 26 would turn on in the event the electronic controller shuts the ice maker down due to a hot gas error. One could consider that a harvest error and a hot gas error are two facets of defrost error. Water error is an important facet of this invention because the control system functions on the basis of using a predetermined loss of water in the sump system 28 to activate harvest. This facet of the microcontroller will be hereinafter described in greater detail.

The electronic controller 10 is fundamentally a microcontroller having a program embedded in a read only memory (ROM) in the microcontroller or connected to a ROM chip containing the program needed to perform the method described in FIGS. 2–6. If the microcontroller does not have sufficient random access memory (RAM) to record data required in the method of this invention, an additional chip containing RAM should be included in the electronic controller. Thus the electronic controller would include a microcontroller chip, i.e., a microcomputer chip, mounted on a circuit board along with other semiconductor chips providing additional ROM and RAM functions. The circuit board would also contain appropriate input and output circuitry to perform the functions hereinafter described. Since this invention focuses on the method performed by the microcontroller, the microcontroller can assume any one of many forms, and need not be described further in this patent application. Valves could be actuated by solenoids, in the usual manner.

Many ice makers include a water sump system 28 which recirculates water from the sump over the evaporator plate 30 where ice accumulates. The evaporator plate 30 is in turn connected to the refrigeration and defrost system 32 for controlling buildup of ice cubes on the evaporator plate and subsequent release of them through a sensing curtain 34 into an ice cube bin 36. The typical water sump system 28 not only has a recirculation system 38 but also a fill valve 40 that is connected to a source of fresh water. Hence the fill valve is, in effect, a fresh water inlet to the water sump system 28. The recirculating water sump system will, of course, have a pump and tubing for bringing water to the evaporator plate and bringing it back to the sump. Many water sump systems include a level sensor 42 in order to perform the method of our invention. The level sensor must not only be just a sensor that indicates when the sump system is full. That sensor or an additional sensor must be used to also indicate when water level in the sump (when the fill valve is closed and freezing cycle is activated) falls to a predetermined level. This indicates that a predetermined volume of water has been removed from the sump by freezing on evaporator plate. Accordingly, in accordance with our invention the inlet, or fill, valve is closed during the freeze cycle so that the drop in water level can be monitored during the freeze cycle. When the water level in the sump drops to a predetermined level, freezing is discontinued and the harvest cycle is initiated.

The diagnostic system of this invention also requires temperature monitoring of the water in the sump. Accordingly, the ice maker of our invention also includes a water sump temperature sensor.

The evaporator plate of an ice maker is frequently an open-faced element having cells in it that form individual ice cube molds. Water is flowed over the evaporator plate during the freeze cycle by means of the water sump recirculation system. once sufficient ice buildup on the plate has occurred, the refrigeration system changes to a defrost mode. In this invention, a refrigeration and defrost system needs to additionally have a liquid line thermistor, as well as an independent control means for the fan motor 46. In ordinary ice makers, once sufficient ice thickness has been achieved on the evaporator plate, the defrost system is actuated, which warms the evaporator plate and releases the ice cubes from the individual ice molds. They would ordinarily fall from the ice molds into an ice cube bin. In some prior art ice making machines they fall through an ice curtain 34. Depending on the particular configuration of the ice machine, the sensing curtain can be a physical element that is pivotally mounted, and physically moved when ice falls from the ice molds on the evaporator plate. This movement can trigger any type of sensing element from a limit switch to an infrared detector or an ultrasonic detector. If no physical curtain is present, a light curtain could be used in which falling ice cubes would break a light or infra-red beam. In any event, some form of sensing curtain is needed to provide an input to the electronic controller so that it can perform the method of this invention.

Often the sensing curtain 34 is located immediately above the ice cube bin 36. In such instance, it may be located close enough to also serve a second function. The second function is to provide an indication as to when the ice bin 36 is full of ice cubes. Ordinarily, ice cube machines have a separate sensor to indicate when the ice bin is full, the separate sensor could be a lever moved by the ice when the bin is full, the lever in turn would be connected to a switch providing an input to the controller that will not allow restart of the freeze cycle. Thus, the broad concept of using a sensor to indicate that the ice cube bin is full is not new. However, in this invention an ice bin sensor is combined with a harvest sensor. The combined sensor is preferably used in connection with water level sensors and timers. It is also preferred that our new control would combine the harvest initiation, harvest termination and bin level control into one electronic device. As hereinbefore indicated, our new control will also sense when the level of sump water has dropped a predetermined amount. Then defrost will be initiated, with defrost termination occurring after all of the harvested cubes fall through a sensing curtain 34 which is preferably located immediately above the ice cube bin.

While we recognize the electromechanical switches can provide sensors for the applications we have in mind, infrared and ultrasonic sensors may offer distinct advantages in some applications.

Figure 2A:
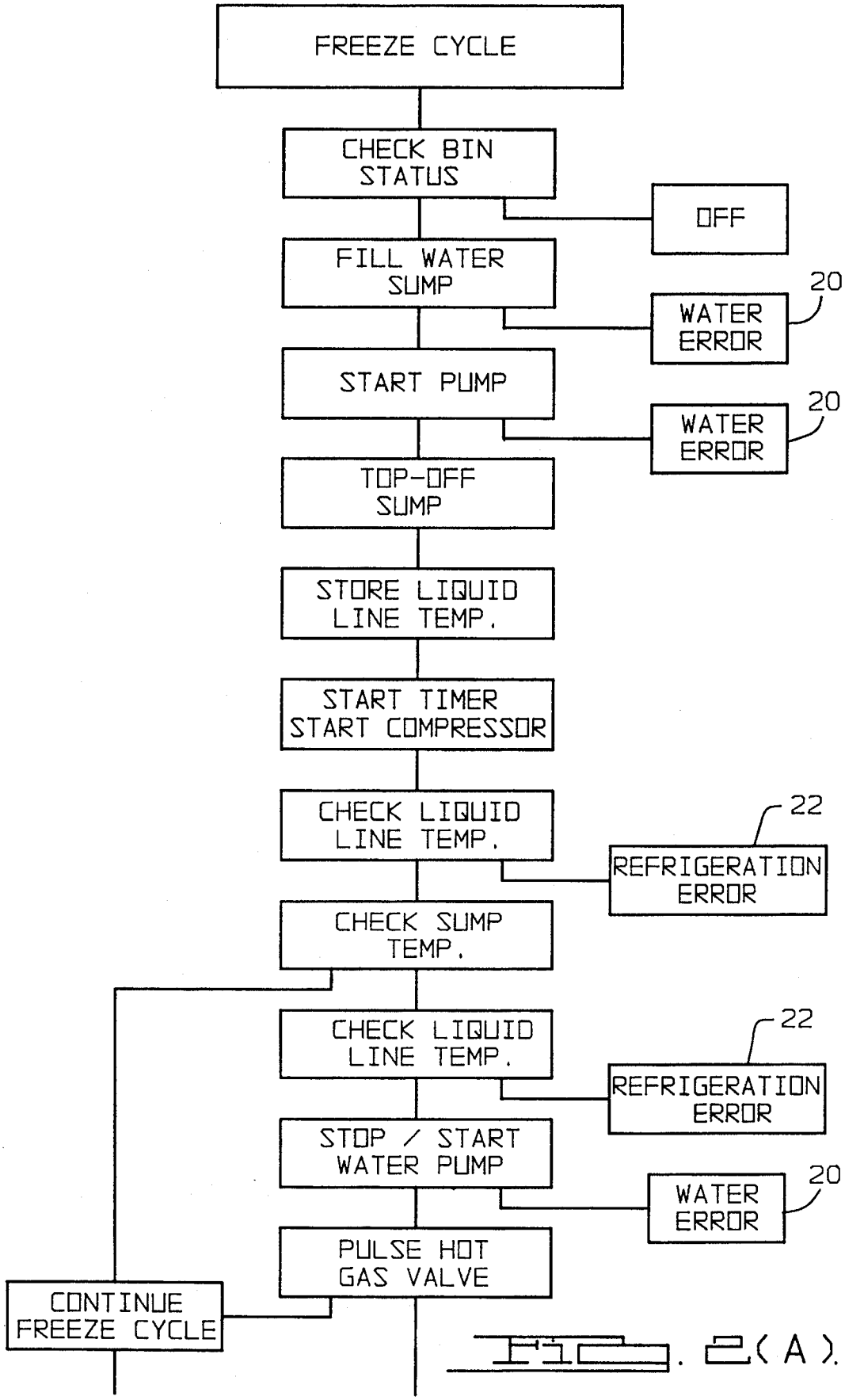
FIG. 2(A) shows the start of a flow diagram of the freeze cycle of this invention, which freeze cycle also includes self-diagnostics and ice maker shutdown in the event of anomalies.
Figure 2B:
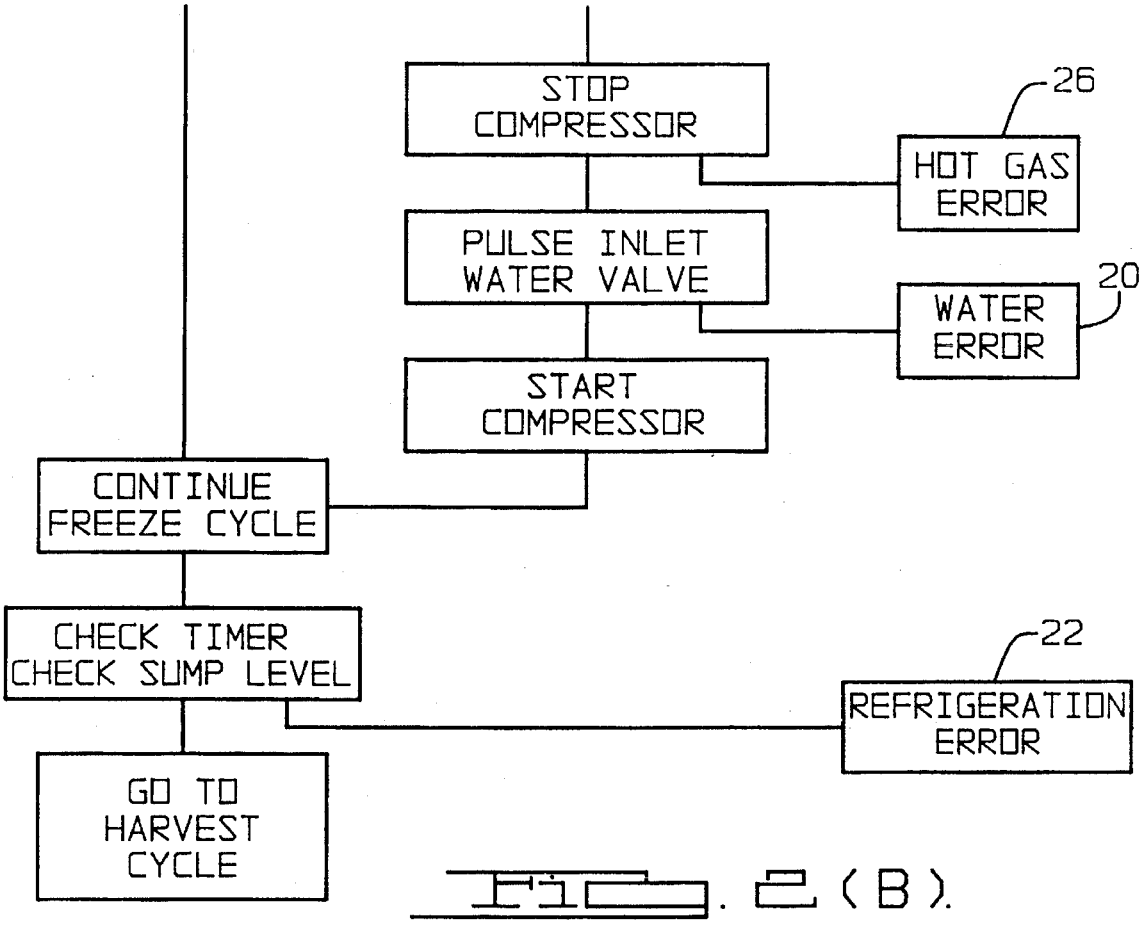
FIG. 2(B) shows completion of the flow diagram started in FIG. 2 (A).
Figure 3:
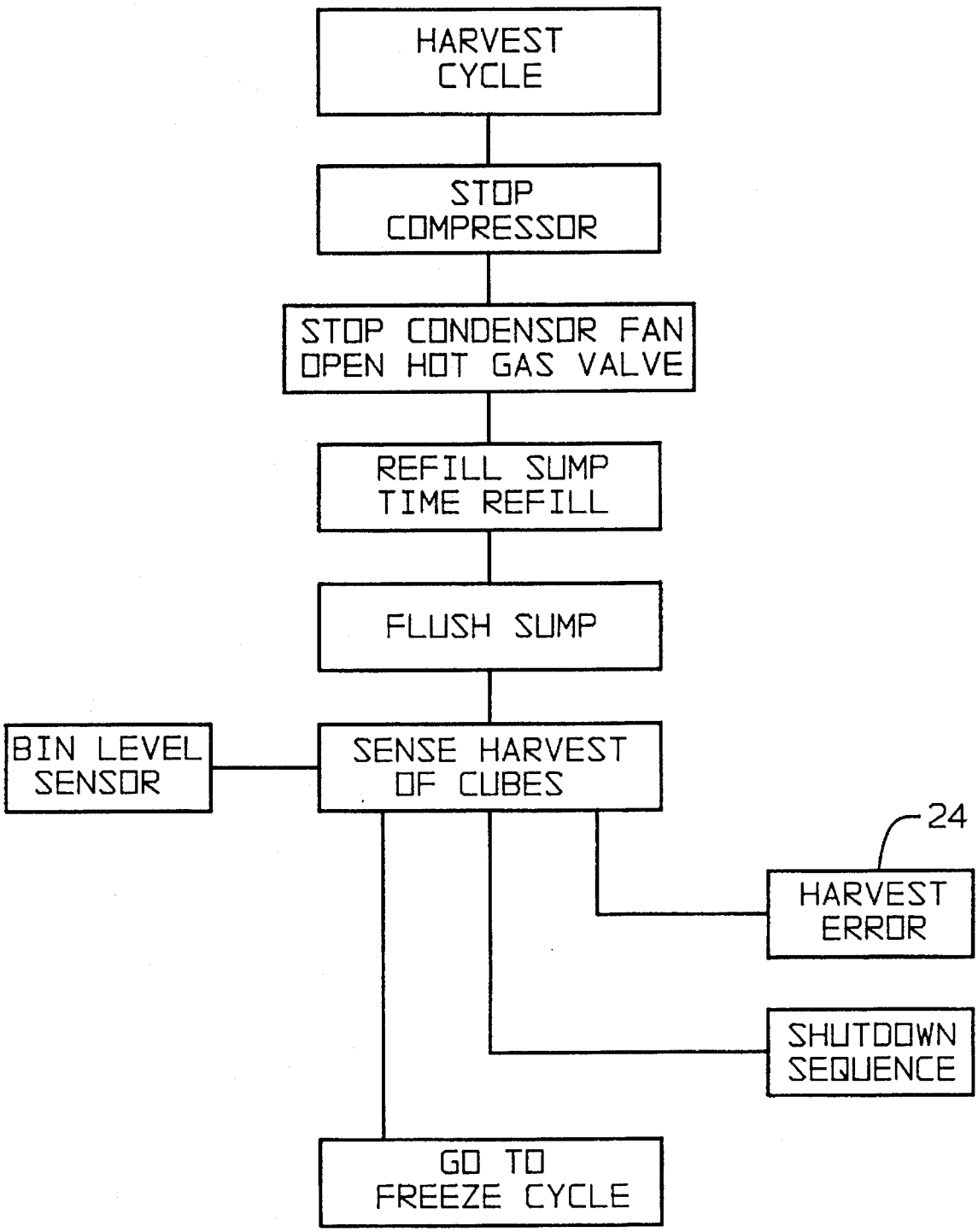
FIG. 3 shows a flow diagram of the harvest cycle performed in accordance with our microcontroller system that also includes self-diagnostics and automatic shutdown for malfunction.
Figure 4:
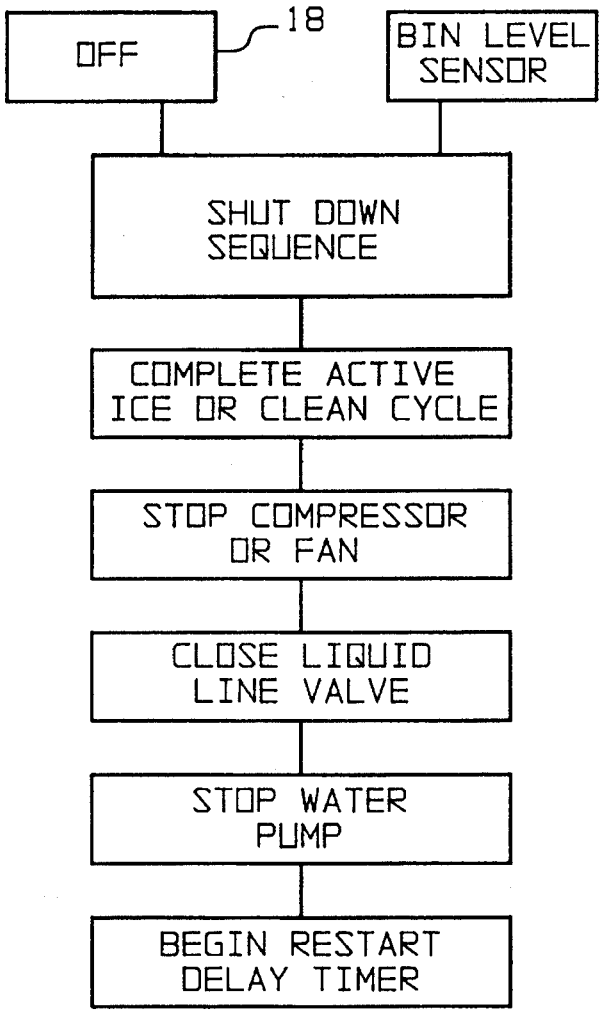
FIG. 4 shows a flow diagram of a shutdown sequence in accordance with this invention.
Figure 5:
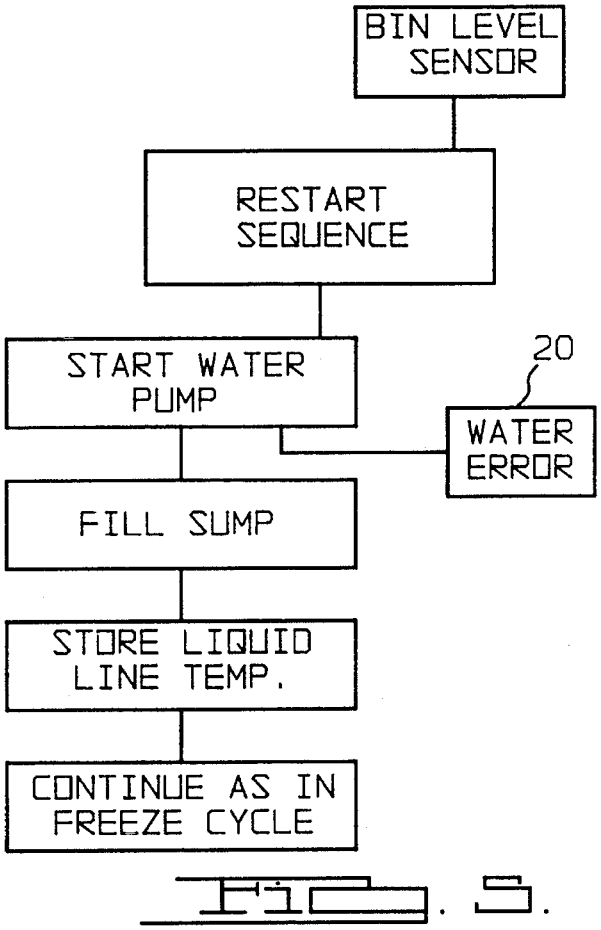
FIG. 5 shows a flow diagram of a restart sequence used in accordance with this invention.
Figure 6:
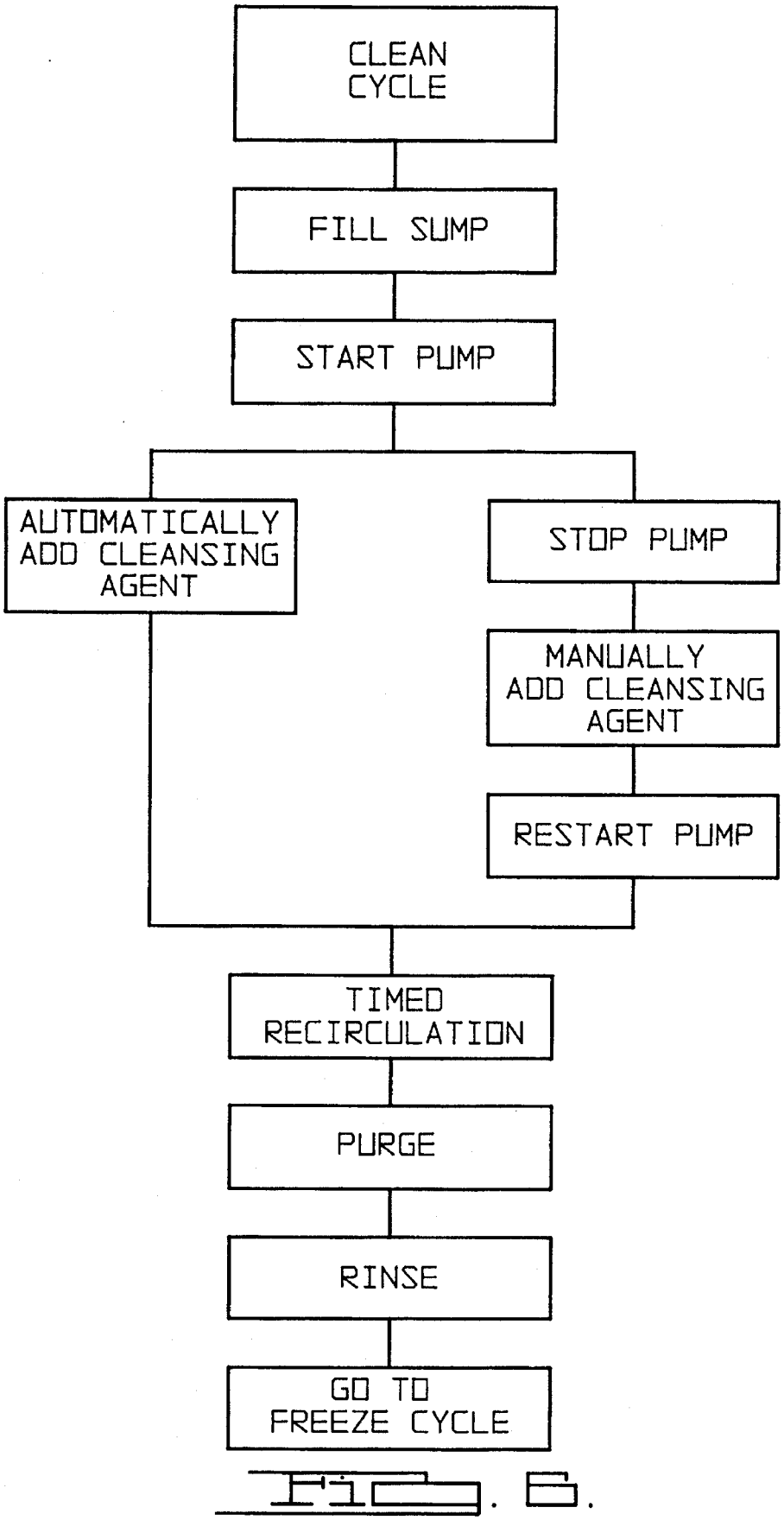
FIG. 6 shows a flow diagram of the cleaning cycle used in the microcontroller of this invention.

Reference is now made to FIG. 2 to describe an operational sequence of an ice machine operating in accordance with the method of this invention. After connection to a power source, the electronic controller 10 will be powered up after turning on the main switch on a control box. At that point, the "OFF" light will be illuminated. As shown in FIG. 2, by depressing the "FREEZE" button 12, the "OFF" light is no longer illuminated and the "FREEZE" light illuminates. This initiates the startup sequence programmed in the electronic controller 10.

When the startup sequence is initiated, the controller first checks to see whether or not there is a signal that indicates that the ice cube bin 36 is full or not. The signal for full ice bin can come from either a special ice bin level sensor or from the sensing curtain 34 that also serves as an ice cube bin level sensor. An open solenoid is triggered on the water sump system fill valve 40 and the water sump system reservoir is filled to its top level. When a top float or other sensor is triggered, a close solenoid is triggered, which closes the water-fill valve 40. If the water does not fill to the top float within 90 seconds, the "WATER ERROR" signal light 20 is illuminated and the ice cube maker is immediately shut down.

If the water does fill the sump to a top float level within 90 seconds, the water temperature in the sump is measured and stored in the electronic controller. The time it takes to fill the sump from its lowest level to its top float or sensor level, is also measured and stored in the microcontroller.

Concurrently, the pump in the water recirculation system is started. If water level in the sump system does not drop below the top float or sensor position, the unit will shut off immediately and the "WATER ERROR" signal light 20 will illuminate. If the water level does drop below the top level when the pump starts, the fill valve 40 is opened again, and the water sump filled to the top level. The fill valve remains open after the water level reaches the top level and the sump is allowed to overfill for a time equal to the fill time that was previously stored.

The liquid line temperature is then measured and stored. The compressor is started and, in the case of remote, the open liquid line solenoid is activated.

The temperature of the discharge line is checked. The electronic controller should cycle the fan as necessary to maintain the minimum discharge line temperature of 150°. If the temperature exceeds 250° , the unit should be shutoff immediately and the signal light 22 "REFRIGERATION ERROR" illuminated.

Temperature of the water in the sump system is also monitored. The temperature should be dropping and approaching freezing temperatures during the first five minutes of ice maker operation in the freeze cycle. If temperature remains substantially constant, or drops only slowly (less than about 10° dropped per minute), or rises, the following diagnostics are performed.

A thermistor 44 on the discharge line is checked. If the discharge line temperature is less than 5° above ambient (liquid line temperature measured during off-cycle just before startup), the compressor and recirculation are immediately shutdown and the "REFRIGERATION ERROR" signal light 22 is illuminated.

If the discharge line temperature is 5° or more above ambient, the water pump in the recirculating system is stopped for 30 seconds and then restarted. If the water level does not drop below the top level on restart, immediately shut the unit down, and illuminate the "WATER ERROR" signal light 20.

If the water level does drop on restart of the recirculation system pump, pulse the hot gas valve once per second for five seconds. If the water sump temperature begins to drop satisfactorily within five minutes, the compressor should remain operating, as well as the recirculation system. In such instance, the freeze cycle would continue until the water level in the sump drops to a predetermined point. Whereon the compressor would be stopped and the harvest cycle initiated.

If no change in water sump temperature occurs within 5 minutes after pulsing the hot gas valve, the compressor should be stopped. If water temperature in the sump stabilizes after five minutes, shut the unit off and illuminate the "HOT GAS ERROR" signal light.

If the temperature continues to rise after stopping the compressor, the inlet water solenoid valve should be pulsed once per second for five seconds. If the water sump temperature stabilizes, restart the compressor and continue with the freeze cycle until water level in the sump lowers to the predetermined level needed to initiate the harvest cycle.

If the water temperature in the sump does not stabilize after the inlet water solenoid was pulsed once per second for five seconds, the water sump system and the refrigeration and defrost system are immediately shut off and the "WATER ERROR" signal light illuminated.

The above-mentioned diagnostics, cause immediate shutoff of the water sump system and the refrigeration system, to prevent unnecessary damage to them in the event they are operating improperly. on the other hand, if the water sump temperature was dropping sufficiently rapidly, the freezing cycle could continue and the above-mentioned diagnostic loop does not have to be entered. In such event, the freezing cycle is continued until sufficient water accumulates on the evaporator plate as ice. One determines that sufficient ice has accumulated on the evaporator plate when the water level in the sump reaches a predetermined low level. The difference in water level is an indication of the amount of ice that has accumulated on the evaporator plate.

While not previously mentioned, the start of the compressor was recorded by the electronic controller and the time during the freeze cycle is monitored. If the freeze cycle exceeds a maximum predetermined freeze time, as for example 40 minutes, the water sump system and refrigeration system is immediately shut off and the "REFRIGERATION ERROR" signal light illuminated.

If the freeze cycle is successfully completed within the maximum freeze time, as for example, 40 minutes, the harvest cycle is initiated. The harvest cycle is initiated by stopping the compressor and the condenser fan, and opening the hot gas valve. The water sump fill valve is opened and the sump allowed to fill to its top level. The time needed to fill the sump from the lowest level is measured and stored.

The sump is then flushed by opening the water inlet valve. This can be a variable feature, allowing flushing for 5%, 10%, 25%, 50% or 100% of fill time. We prefer that the standard flushing time be 10% of the fill time. At the end of the flush time, the water inlet valve is closed until the freeze cycle is initiated again.

The evaporator plate 30 is allowed to warm by the hot gas until it defrosts. Incidentally, it is recognized that while use of hot gas may be a convenient and most typical form of defrosting the evaporator plate, to remove the ice, other defrosting means could be used as well. One might even choose to use an electric heating means built into the evaporator plate. In any event, warming of the evaporator plate is allowed to proceed until the ice cubes are released from the evaporator plate. Generally, the evaporator plate is oriented so that each ice cube will fall by gravity from its mold upon warming of the evaporator plate. When the ice cube falls from the evaporator plate, it will fall through the sensing curtain.

A timer is started at the beginning of the harvest cycle. If no cubes fall through the sensing curtain in the first two minutes of harvest, the refrigeration and defrost system is deactivated immediately and the "HARVEST ERROR" signal light is illuminated. If cubes fall through the curtain before the first two minutes of harvest, but continue to fall after five minutes of harvest is exceeded, the refrigeration and defrost system is shutdown and the "HARVEST ERROR" signal light 24 illuminated.

Accordingly, satisfactory operation means that ice cubes will fall through the sensing curtain 34 during the first two minutes of harvest and all of them will have fallen through it before five minutes of harvest passes.

The next step in the method is for the electronic controller to check to see if the ice cube bin 36 is full or not. As hereinbefore indicated this signal could come from the sensing curtain 34, if the sensing curtain is appropriately positioned above the ice cube bin. If the sensor indicates that the ice cube bin is full, or if the harvest cycle was initiated manually by pressing the "HARVEST" push button 14, the hot gas valve is closed, and the microcontroller proceeds through the shutdown sequence illustrated in FIG. 4. If, on the other hand, the harvest cycle was automatically initially initiated after the freeze cycle ended, and if there is no indication that the ice bin is full, the compressor is allowed to continue pumping, and the freeze cycle re-entered again. If desired, it can be re-entered by restarting the circulation pump and detecting for a drop in the water level. However, one may elect to re-enter the refreeze cycle at a later stage as, for example, at the step where one checks for the significantly dropping water temperature in the sump. In any event one would choose to re-enter the freeze cycle at some step before the diagnostics loop, so that the diagnostics loop is present in each freeze cycle.

The diagnostics loop provides for immediate shutdown of the ice cube maker in the event of malfunction detection during the freeze cycle. On the other hand, a 0shutdown sequence of another type can be initiated by a sensor indicating that the ice cube bin 36 is full or depressing the "OFF switch 18 on the control panel.

As previously indicated, the bin full signal can come from a separate bin level control sensor or from the sensing curtain acting in a dual function. If the "Off" switch 18 is utilized or if the bin full signal triggers the shutdown sequence, the electronic controller allows the unit to complete a freeze or clean cycle, if it has initiated that cycle at the time the "OFF" switch or bin full signal is triggered. In case of manual shutdown, by pressing the "OFF" push button, the "OFF" push button signal light would become illuminated as soon as the "OFF" push button was depressed.

Once the shutdown sequence is initiated, the active ice or clean cycle is allowed to be completed, whereupon the compressor and fan is stopped or the liquid line solenoid valve closed. The electronic controller 10 can ensure that the unit shall remain off for a minimum of six minutes.

If the ice cube maker was shutdown due to receiving a bin full signal, automatic restart of the freezing cycle is initiated (after the predetermined minimum shutoff time expires) when the bin full signal is discontinued. The bin full signal could be discontinued, for example, through meltage or removal of ice cubes from the ice cube bin. In such event, the water pump is restarted if the water level in the sump does not drop below the top level of the sump, the water pump is shut of f and the "WATER ERROR" signal light 20 illuminated. If the water level does drop when the water pump is turned on, the water valve is opened and the sump filled to its top level, from there one can reinitiate the freezing cycle as, for example, starting at the step where the liquid line temperature is measured and stored and the timer and compressor started. As previously indicated, one would prefer to enter the freezing cycle prior to the diagnostic loop, so that the diagnostic loop would be a part of the freeze cycle.

It should be mentioned, that manual defrost is manually initiated by depressing the "HARVEST" switch 14. One could also consider this to be a manual harvest.

The clean cycle can be initiated manually by depressing the "CLEAN" switch 16. It can also automatically be initiated periodically by the electronic controller. In either case, the signal light on the "CLEAN" push button 16 illuminates when the "CLEAN" push button is depressed, and the cycle activated. The signal light remains illuminated during the entirety of the clean cycle.

If desired, one can program the electronic controller to respond to the pressing of the "CLEAN" push button 16 during the freeze and/or harvest cycles. In such event, one might chose that depression of the "CLEAN" push button during such cycles activates the signal light on the "CLEAN" push button but allows the unit to complete the freeze or harvest cycle. After the freeze or harvest cycle is completed, the clean cycle initiates. The electronic controller can be programmed still further to allow depressing of the "OFF" button 18 during the clean cycle to produce an analogous function. In such instance, the "OFF" button signal light will illuminate and the machine will enter the shut down sequence at the end of the clean cycle.

If the ice maker has means for automatically dispensing a cleaning agent to the sump, the electronic controller can be programmed to provide automatic cleaning. This would occur on a programmable periodic basis during the off hours. It might even be controllable by an external module. once the clean cycle is initiated, the inlet water valve is opened and water allowed to flow into the sump until the sump is filled to its top level. The water valve is then closed and the water pump started. If the cleaning step was initiated from the "OFF" position, the water pump must be started and the sump filled to top of the sump again after the pump starts. At this point, the user would manually input the cleaning or sanitizing solution if the unit was not equipped with the automatic cleaning module. The system should be allowed to circulate for ten minutes. Depending on the ice cube maker, one may choose to stop the pump, manually add the cleansing agent and then restart the pump. In such event, the water fill valve should be opened again to fill the sump to its highest level.

Once the cleaning or sanitizing solution has been added to the sump and the sump is filled with the pump running, the system is allowed to circulate for ten minutes. After ten minutes, the water inlet valve to the sump is opened and the sump allowed to purge for a time at least equal to the time required to fill it. This would correspond to the time, last stored in the electronic controller, that was required to fill the sump.

The refilled sump is allowed to circulate for one minute. The purge and circulation for one minute is repeated five more times, for a total of six complete cycles. If power is lost during the cleaning cycle, the remaining rinsing cycles must be completed before the freeze cycle is reinitiated. A battery or capacitor backup of the electronic controller can be provided so that the electronic controller automatically completes the remaining cycles when power is restored.

After the sixth complete cycles of purge and recirculate are completed, and if the "OFF" push button 18 was not depressed during the "CLEAN" cycle, the freeze cycle is automatically reinitiated by measuring and storing the liquid line temperature, starting the timer and starting the compressor. As hereinbefore indicated, one should enter the freeze cycle prior to the diagnostic loop.

While the "FREEZE", "HARVEST", "CLEAN", AND "OFF" switches 12–18 are designated as push buttons in the foregoing description recognizes that the switches can be of any type suitable for a customer control panel. The illumination of the push buttons is optional, as is disposition of the error signal lights. As for electrical characteristics, the electronic controller can be a single module on a circuit board adaptable to any convenient voltage source. A 24-volt supply transformer can be used for solenoids and sensors. Thermistors for the sump would have a total range of 33° to 120° with a nominal rating of 40°. The discharge line thermistor would have a total range of 50° to 250° with a nominal of 100°.

This new system of ice maker operation is extremely reliable and commercially effective. It is relatively simple in operation and reliably harvests ice cubes under various ambient conditions. It diagnoses malfunctions and shifts itself off when malfunctions occur. Accordingly, when anomalies occur, the ice cube maker not only stops before destroying itself but also provides a visible indication as to what system is in error.

The foregoing detailed description shows that the preferred embodiments of the present invention are well suited to fulfill the objects above stated. It is recognized that those skilled in the art may make various modifications or additions to the preferred embodiments chosen to illustrate the present invention without departing from the spirit and proper scope of the invention. For example, various types of sensors in an electronic controller configurations may be developed based upon the teachings provided herein. Accordingly, it is understood that the protection sought and to be afforded hereby should be deemed to extend to the subject matter defined by the intended claims, including all fair equivalents thereof.

What is claimed is:

1. A method of operating an ice cube maker having evaporator means that includes ice-forming means and a sump and water recirculation means for said evaporator means and further having cooling means including compressor means and condenser means for cooling the evaporator means to freeze ice on said ice-forming means in a normal refrigeration cycle, and including means for defrosting said evaporator means to harvest ice from said evaporator means in a harvest cycle, said method comprising the steps of:

filling the water recirculation means with water;

filling the sump to an overflow level;

sensing when the sump is filled to overflow level and terminating in-flow of water into said sump;

initiating recirculation of said water from said sump into contact with said evaporator plate and back to said sump;

initiating cooling of the evaporator plate, effective to progressively precipitate portions of the recirculating water as ice on said evaporator plate and reduce water level in said sump;

sensing when water level in said sump is reduced to a predetermined lower level;

discontinuing recirculation of said water between said evaporator plate and said sump, and terminating cooling of the evaporator plate after sensing that water level in said sump has reduced to said predetermined level, effective to conclude a freeze cycle;

warming said evaporator plate to initiate harvest of ice cubes from the evaporator plate;

sensing the fall of ice cubes from the evaporator plate during a first time interval after initiating harvest, wherein detection of falling cubes during the first time interval provides a provisional signal to repeat the freeze cycle after the end of a second time interval;

discontinuing the warming of the evaporator plate after a predetermined time period that ends after conclusion of said first time interval;

sensing the fall of ice cubes from the evaporator during a second time interval after all of the ice cubes are expected to have fallen from the evaporator plate, wherein detection of falling cubes provides a final signal that negates said provisional signal to repeat the freeze cycle; and repeating the freeze cycle if said first signal is detected but not said second signal.

2. The method of operating an ice cube maker as recited in claim 1 wherein:

the recirculation means is filled with water by opening the water fill valve and filling the water sump to the overflow level, recirculating the water between the sump and the evaporator plate, detecting if water level in the sump lowers as the recirculation means fills with water, and then opening the water fill valve to re-fill the sump to over flow level, effective to provide an known quantity of water in the sump even after filling the circulation means with water.

3. The method of operating an ice cube maker as recited in claim 1 wherein:

repeat of the freeze cycle commences only after the sump is refilled to the overflow level and refill time is recorded.

4. The method of operating an ice cube maker as recited in claim 3 wherein:

the falling of ice cubes and the presence of excess ice cubes in the storage bin is sensed using the same sensor; and recirculation of water and cooling of the evaporator plate does not commence if the sump does not fill to a predetermined level within a predetermined time, and a telltale signal is activated that indicates water error.

5. The method of operating an ice cube maker as recited in claim 1 wherein:

the water recirculation system and the refrigeration/defrost system is stopped immediately if ice cubes are detected falling during the second time interval, and a telltale signal is activated that indicates harvest error.

6. The method of operating an ice cube maker as recited in claim 4 wherein:

the water recirculation system and the refrigeration/defrost system is stopped immediately if ice cubes are detected during the second time interval, and a telltale signal is activated that indicates harvest error.

7. The method of operating an ice cube maker as recited in claim 6 that includes the further steps of:

measuring the time it takes for the water level in the sump to reduce to the predetermined lower level, and stopping the recirculation of water and the cooling of the evaporator plate if the water level has not reduced to said predetermined lower level within a predetermined maximum freeze time, while also activating a telltale signal to indicate refrigeration error.

8. The method of operating an ice cube maker as recited in claim 7 that further includes the diagnostic steps of:

monitoring water sump temperature during at least an initial time period of the freezing cycle;

if water sump temperature does not drop at least as f d as a predetermined rate during said time period, performing the following additional diagnostic steps;

checking liquid line temperature of the refrigeration/defrost system;

if liquid line temperature is less than a predetermined amount above ambient temperature, stopping the compressor and activating a refrigeration error telltale;

if liquid line temperature at least equals the predetermined rate, stopping recirculation of the sump water for a given period of time, allowing recirculation system water to drain back into the sump and overflow it, and then restarting the recirculation of sump water;

if sump water level does not drop from overflow level upon restart of recirculation, stopping said sump water recirculation and said cooling of the evaporator plate and activating a water error telltale;

if sump water level drops from overflow level upon restart of recirculation, pulsing a valve controlling hot gas access to the evaporator plate and continuing to monitor sump water temperature during a subsequent time period;

if sump water temperature drops at least equal to a predetermined rate during said subsequent time period, discontinuing additional diagnostic steps and restarting cooling of the evaporator plate, so as to continue the freezing cycle;

if sump water temperature does not drop at least equal to a predetermined rate during said subsequent time period, stopping the compressor for a predetermined dwell period without stopping recirculation;

if sump water temperature stabilizes during said dwell period, also stopping recirculation and activating a hot gas error telltale;

if sump water temperature continues to rise during the dwell period, pulsing a valve controlling inlet of water to the sump for a predetermined period;

if water sump temperature stabilizes during a predetermined period following water valve pulsation, restarting cooling of the evaporator plate and continuing the freezing cycle; and if water sump temperature does not stabilize during said predetermined period following water valve pulsation, discontinuing recirculation of sump water without restarting cooling of the evaporator plate, and activating a water error telltale.

9. In an ice cube maker having evaporator means including ice-forming means including a sump and water recirculation means for said evaporator and having cooling means including compressor means and condenser means for cooling the evaporator means to freeze ice on said ice-forming means in a normal refrigeration cycle, and including means for defrosting said evaporator means to harvest ice from said evaporator means in a harvest cycle, improved control means that comprises:

first sensor means for detecting water level when said sump is effectively full;

second sensor means for detecting water level at a predetermined less-than-full level, the detection of which predetermined less-than-full level is used to indicate that a given quantity of water has been removed from the sump and converted to ice on the evaporator means;

electronic control means responsive to inputs from said first and second sensor means, to initiate a freezing cycle only after an input from said first sensor means and to terminate the freezing cycle and initiate a harvest cycle upon receipt of an input from the second sensor means; and actuator means, activated by said control means, for initiating an evaporator defrost cycle, by which ice cubes can be harvested from said evaporator plate.

10. The ice cube maker as recited in claim 9 that further includes:

at least one timer means;

a third sensor means for detecting fall of ice cubes from the evaporator plate and excess cubes in an ice cube storage bin during two time intervals following initiation of the harvest cycle; and means integral to the control means for regulating said timer means and accepting inputs from said third sensor means during said first and second time intervals and directing further control in response to inputs from said third sensor means, whereby the control means has the option of repeating a freezing cycle if an input is received from the third sensor means during the first time interval but not the second, or of activating a harvest error signal light and concurrently interrupting restart of the freezing cycle if an input is not received from the third sensor during the first time interval or if it is received during the second time interval.

11. The ice cube maker of claim 9 that further includes the steps of:

means for measuring water sump temperature during at least an initial time period of the freezing cycle;

means for comparing water sump temperature change to a standard during said period;

means for checking liquid line temperature of the refrigeration/defrost system in response to a signal from said comparing means;

means responsive to said checking means for stopping the compressor and illuminating a refrigeration error telltale;

means responsive to said checking means for stopping recirculation of sump water for a given period of time, allowing recirculation system water to drain back into the sump and overflow it, and then restarting recirculation of sump water;

means for detecting water level change upon restart of recirculation;

means responsive to said water level change detection means for stopping said sump water recirculation and said cooling of the evaporator plate and activate a water error telltale;

means also responsive to said water level change detection means for pulsing a valve controlling hot gas access to the evaporator plate and for continuing monitor sump water temperature during a subsequent time period;

means responsive to said means for comparing sump water temperature change to a standard, during a time period after hot gas pulsation, for continuing activation of said evaporator plate cooling means;

means, responsive to said means for comparing sump water temperature change to a standard during said time period after hot gas pulsation, for deactivating said evaporator plate cooling means for a predetermined dwell period without stopping sump water recirculation;

means, responsive to said means for comparing sump water temperature change to a standard during said time period after hot gas pulsation, for not only deactivating said evaporator plate cooling means but also for stopping sump water recirculation and activating a hot gas error telltale if sump water temperature stabilizes during said dwell time period;

means, responsive to said means for comparing sump water temperature change to a standard during said time period after hot gas pulsation, for pulsing a valve controlling water inlet to the sump for a predetermined time period if water sump temperature rises during said swell period; and means, responsive to said means for comparing sump water temperature change to a standard during a time period after water valve pulsation, for stopping water recirculation in addition to deactivation of said evaporator cooling means, and for also activating water error telltale.

12. A method of ice making that comprises the steps of:

filling a sump to provide a known quantity of water;

monitoring sump fill time;

if said sump does not fill within a predetermined time, activating a telltale indicating water error, and not commencing recirculation of said water between an evaporator plate of an ice maker and said sump;

if said sump fills within said predetermined time, commencing said recirculation of said water onto said evaporator plate and back to the sump, while cooling the evaporator plate to temperatures that will freeze water into ice;

if said recirculation is commenced, continuing to recirculate said water onto said evaporator plate as portions of said water freeze into ice on said evaporator plate, thereby reducing said water to a quantity less than said known quantity;

detecting when the water quantity is reduced to a predetermined amount;

discontinuing the recirculation of said water onto said evaporator plate and the cooling of the evaporator plate after detecting said reduced predetermined amount;

initiating a harvest cycle of the ice frozen on said evaporator plate;

sensing for the fall of ice cubes from the evaporator plate during a first time interval after initiating harvest, and for the presence of excess ice cubes in a related storage bin; and if falling ice cubes are sensed during said time interval and if no excess ice cubes are detected in said storage bin, repeating a freeze cycle on said evaporator plate that includes the afore-mentioned steps.

13. A method of ice making that comprises the steps of:

filling a sump of a water recirculation system to provide a known quantity of water;

recirculating said water onto an evaporator plate of an ice maker and back to said sump while using a refrigeration/defrost system to cool the evaporator plate to temperatures that will freeze water into ice;

continuing to recirculate said water onto said evaporator plate as portions of said known quantity of water freeze into ice on said evaporator plate, thereby reducing said water to a quantity less than said known quantity of water;

detecting when water quantity is reduced a predetermined amount from said known water quantity;

discontinuing the recirculation of said water onto said evaporator plate and the cooling of the evaporator plate after detecting said reduced predetermined amount;

initiating a harvest cycle of the ice frozen on said evaporator plate;

sensing for the fall of ice cubes from the evaporator plate during a first predetermined time interval after initiating harvest, and for the presence of excess ice cubes in a related storage bin using the same sensor;

if falling ice cubes are sensed during said first predetermined time interval and if no excess ice cubes are detected in said storage bin, repeating a freeze cycle on said evaporator plate that includes the afore-mentioned steps; and if falling ice cubes are sensed during a second predetermined time interval after initiating harvest, stopping the water recirculation and the refrigeration/defrost system, and activating a telltale signal that indicates harvest error.

14. A method of ice making that comprises the steps of:

filling a sump of a water recirculation system to provide a known quantity of water;

recirculating said water onto an evaporator plate of an ice maker and back to the sump;

starting a refrigeration/defrost system which cools the evaporator plate to temperatures that will freeze water into ice;

checking liquid line temperature of the refrigeration/defrost system after compressor start;

controlling condenser fan in response to liquid line temperature;

if liquid line temperature exceeds a predetermined temperature, stopping the compressor and activating a telltale signal that indicates refrigeration error;

if liquid line temperature does not exceed said predetermined temperature, continuing to recirculate said water onto said evaporator plate as portions of said water freeze into ice on said evaporator plate, thereby reducing said water to a quantity less than said known quantity;

detecting when the water quantity is reduced a predetermined amount;

discontinuing recirculation of said water onto said evaporator plate and cooling of the evaporator plate after detecting said predetermined reduced amount;

initiating a harvest cycle of the ice frozen on said evaporator plate;

sensing for the fall of ice cubes from the evaporator plate during a first time interval after initiating harvest, and for the presence of excess ice cubes in a related storage bin; and if falling ice cubes are sensed during said time interval and if no excess ice cubes are detected in said storage bin, repeating a freeze cycle on said evaporator plate that includes the afore-mentioned steps.

15. A method of ice making that comprises the steps of:

filling a sump of an ice maker to a predetermined high level, to provide a known quantity of water;

commencing a freeze cycle by starting recirculation of said water between an evaporator plate of an ice maker and said sump while cooling the evaporator plate to temperatures that will freeze water into ice;

monitoring water sump temperature during at least an initial time period of the freezing cycle;

if water sump temperature does not drop at least as fast as a predetermined rate during said time period, performing the following additional diagnostic steps;

checking liquid line temperature of the refrigeration/defrost system;

if liquid line temperature is less than a predetermined amount above ambient temperature, stopping the compressor and illuminating a refrigeration error telltale;

if liquid line temperature at least equals the predetermined rate, stopping recirculation of the sump water for a given period of time, allowing the recirculation system water to drain back into the sump and overflow it, and then restart the recirculation of said pump water;

if sump water level does not drop from overflow level upon restart of recirculation, stopping said sump water recirculation and said cooling of the evaporator plate, and activating a water error telltale;

if sump water level drops from overflow level upon restart of recirculation, pulsing a valve controlling hot gas access to the evaporator plate and continuing to monitor sump water temperature during a subsequent time period;

if sump water temperature drops at least equal to a predetermined rate during said subsequent time period, discontinuing additional diagnostic steps and restarting cooling of the evaporator plate, so as to continue the freezing cycle;

if sump water temperature does not drop at least equal to a predetermined rate during said subsequent time period, stopping the compressor for a predetermined dwell period without stopping recirculation;

if sump water temperature stabilizes during said dwell period, also stopping recirculation and activating a hot gas error telltale;

if sump water temperature continues to rise during the dwell period, pulsing a valve controlling inlet of water to the sump for a predetermined period;

if water sump temperature stabilizes during a predetermined period following water valve pulsation, restarting cooling of the evaporator plate and continuing the freezing cycle;

if water sump temperature does not stabilize during said predetermined period following water valve pulsation, discontinuing recirculation of sump water without restarting cooling of the evaporator plate, and activating a water error telltale.

if recirculation of said water onto said evaporator plate is continued, and the cooling of the evaporator plate is restarted, freezing portions of said water into ice on said evaporator plate, and thereby reducing said water in said sump to a quantity less than said known quantity;

detecting when the water quantity in said sump is reduced a predetermined low level;

discontinuing recirculation of said water onto said evaporator plate and cooling of the evaporator plate after detecting said predetermined reduced amount;

initiating a harvest cycle of the ice frozen on said evaporator plate;

sensing for the fall of ice cubes from the evaporator plate during a first time interval after initiating harvest, and for the presence of excess ice cubes in a related storage bin; and if falling ice cubes are sensed during said time interval and if no excess ice cubes are detected in said storage bin, repeating a freeze cycle on said evaporator plate that includes the afore-mentioned steps in which said sump is refilled to said high level and said recirculation of water is initiated again.

16. A method of ice making that comprises the steps of:

filling a sump of a water recirculation system to provide a known quantity of water;

monitoring water sump temperature during at least an initial time period of a following freezing cycle in which water is cooled while being recirculated onto an evaporator plate;

recirculating said water onto an evaporator plate of an ice maker and back to the sump;

starting a refrigeration/defrost system which cools the evaporator plate to temperatures that will freeze water into ice;

if water sump temperature does not drop at least as fast as a predetermined rate during said initial time period, performing the following additional diagnostic steps;

checking liquid line temperature of the refrigeration/defrost system;

if liquid line temperature is less than a predetermined amount above ambient temperature, stopping the compressor and illuminating a refrigeration error telltale;

if liquid line temperature at least equals the predetermined rate, stopping recirculation of the sump water for a given period of time, allowing recirculation system water to drain back into the sump and overflow it, and then restarting the recirculation of sump water;

if sump water level does not drop from overflow level upon restart of recirculation, stopping said sump water recirculation and said cooling of the evaporator plate, and activating a water error telltale;

if sump water level drops from overflow level upon restarting recirculation, pulsing a valve controlling hot gas access to the evaporator plate and continuing to monitor sump water temperature during a subsequent time period;

if sump water temperature drops at least equal to a predetermined rate during said subsequent time period, discontinuing additional diagnostic steps and restarting cooling of the evaporator plate, so as to continue the freezing cycle;

if sump water temperature does not drop at least equal to a predetermined rate during said subsequent time period, stopping the compressor for a predetermined dwell period without stopping recirculation;

if sump water temperature stabilizes during said dwell period, also stopping recirculation and activating a hot gas error telltale;

if sump water temperature continues to rise during the dwell period, pulsing a valve controlling inlet of water to the sump for a predetermined period;

if water sump temperature does not stabilize during said predetermined period following water valve pulsation, discontinuing recirculation of sump water without restarting cooling of the evaporator plate, and activating a water error telltale;

if water sump temperature stabilizes during a predetermined period following water valve pulsation, restarting cooling of the evaporator plate and continuing the freezing cycle;

checking liquid line temperature of the refrigeration/defrost system after compressor start;

controlling condenser fan in response to liquid line temperature;

if liquid line temperature exceeds a predetermined temperature, stopping the compressor and activating a telltale signal that indicates refrigeration error;

if liquid line temperature does not exceed said predetermined temperature, continuing to recirculate said water onto said evaporator plate as portions of said water freeze into ice on said evaporator plate, thereby reducing said water to a quantity less than said known quantity;

detecting when the water quantity is reduced a predetermined amount;

discontinuing recirculation of said water onto said evaporator plate and cooling of the evaporator plate after detecting said predetermined reduced amount;

initiating a harvest cycle of the ice frozen on said evaporator plate;

sensing for the fall of ice cubes from the evaporator plate during a first time interval after initiating harvest, and for the presence of excess ice cubes in a related storage bin; and if falling ice cubes are sensed during said time interval and if no excess ice cubes are detected in said storage bin, repeating a freeze cycle of water on said evaporator plate that includes the afore-mentioned steps.

* * * * *

UNITED STATES PATENT AND TRADEMARK OFFICE

CERTIFICATE OF CORRECTION

PATENT NO. : 5,477,694

DATED : December 26, 1995

INVENTOR(S) : William J. Black et al

It is certified that error appears in the above-indentified patent and that said Letters Patent is hereby corrected as shown below:

Col. 2, line 25, "Fig. 2(A)." should be --FIG. 2(A)

Col. 2, line 54, "are" should be --of--

Col. 2, line 67, "al-" should be --al.--

Col. 4, line 14, insert "the" before "evaporator"

Col. 4, line 30, "once" should be "Once"

Col. 4, line 48, "infra-red" should be --infrared--

Col. 5, line 58, "shutoff" should be --shut off--

Col. 6, line 20, "point. Whereon" should be --point, whereon--

Col. 6, line 40, "diagnostics," should be --diagnostics--

Col. 6, line 43, "on" should be --On--

Col. 7, line 57, "0shutdown" should be --shutdown--

UNITED STATES PATENT AND TRADEMARK OFFICE

CERTIFICATE OF CORRECTION

PATENT NO. : 5,477,694

DATED : December 26, 1995

INVENTOR(S) : William J. Black et al

It is certified that error appears in the above-indentified patent and that said Letters Patent is hereby corrected as shown below:

Col. 7, line 60, ""OFF " should be --"OFF"--

Col. 7, line 63, "Off"should be --"OFF"--

Col. 8, line 18, "of f" should be --off--

Col. 8, line 21, "level," should be --level;--

Col. 8, line 42, "chose" should be --choose--

Col. 8, line 56, "once" should be --Once--

Col. 9, line 27, "AND" should be --and--

Col. 10, line 55, claim 2, "an" should be --a--

Col. 11, line 30, claim 8, "f d" should be --fast--

Col. 11, line 32, claim 8, "steps;" should be --steps:--

Col. 16, line 6, claim 15, "telltale." should be --telltale;--

Signed and Sealed this

Sixth Day of August, 1996

*Attest:*

*Attesting Officer*

BRUCE LEHMAN

*Commissioner of Patents and Trademarks*